US012030829B2

(12) United States Patent
Rose et al.

(10) Patent No.: US 12,030,829 B2
(45) Date of Patent: Jul. 9, 2024

(54) FIRE STARTER

(71) Applicant: 3rd Light IP Holdings LLC, Pahrump, NV (US)

(72) Inventors: James Rose, Reading (GB); John Perriam, Reading (GB)

(73) Assignee: 3RD LIGHT IP HOLDINGS LLC, Pahrump, NV (US)

( * ) Notice: Subject to any disclaimer, the term of this patent is extended or adjusted under 35 U.S.C. 154(b) by 41 days.

(21) Appl. No.: 17/979,805

(22) Filed: Nov. 3, 2022

(65) Prior Publication Data

US 2024/0150258 A1 May 9, 2024

(51) Int. Cl.

| | |
|---|---|
| ***C06B 27/00*** | (2006.01) |
| ***C06B 29/16*** | (2006.01) |
| ***C06B 47/00*** | (2006.01) |
| ***F23Q 1/06*** | (2006.01) |
| ***F23Q 2/18*** | (2006.01) |
| ***F23Q 2/36*** | (2006.01) |

(52) U.S. Cl.

CPC ..... *C06B 47/00* (2013.01); *C06B 27/00* (2013.01); *C06B 29/16* (2013.01); *F23Q 1/06* (2013.01); *F23Q 2/18* (2013.01); *F23Q 2/36* (2013.01)

(58) Field of Classification Search

CPC . C06B 27/00; C06B 29/16; F23Q 1/06; F23Q 2/18; F23Q 2/36

USPC ..... 149/15

See application file for complete search history.

(56) References Cited

U.S. PATENT DOCUMENTS

| | | | | |
|---|---|---|---|---|
| 1,338,380 | A * | 4/1920 | Leich | H02M 7/36 178/2 R |
| 2,640,770 | A * | 6/1953 | Magram | C06C 9/00 149/114 |
| 11,415,318 | B2 | 8/2022 | Beyrodt | |
| 2016/0100651 | A1* | 4/2016 | Rastegar | H02K 7/1861 36/2.6 |
| 2020/0378601 | A1* | 12/2020 | Beyrodt | F23Q 3/00 |

* cited by examiner

*Primary Examiner* — James E McDonough

(74) *Attorney, Agent, or Firm* — Bayramoglu Law Offices LLC

(57) ABSTRACT

The present disclosure provides a fire starter that does not require oxygen from the air to ignite or maintain a flame and makes it easy to ignite using one or no fingers, such as teeth. A fire starter includes a burnable casing forming a sealed chamber. A first burnable mixture and a second burnable mixture are separately disposed in the sealed chamber. The first burnable mixture can form a flame without oxygen from the air. An igniter is disposed in the sealed chamber adjacent to the first burnable mixture and configured to generate a first thermal event to ignite the first burnable mixture without oxygen from the air. The first burnable mixture combusts during the first thermal event and triggers a second thermal event to ignite the second burnable mixture. An actuator is configured to activate the igniter to generate the first thermal event without using more than one finger.

19 Claims, 3 Drawing Sheets

FIRE STARTER

TECHNICAL FIELD

The present invention relates generally to a fire starting apparatus and more particularly to an oxygen-free fire starter.

BACKGROUND

Traditional methods of starting a fire in an outdoor environment can be time-consuming and unreliable. Typically, one starts a fire by placing dry kindling wood and paper below a stack of logs or charcoal. The paper is ignited and, if all goes well, the stack of logs eventually ignites. However, the success of traditional methods depends on several factors, including weather conditions, the amount and condition of combustible materials used, and the user's experience. For example, windproof matches require ignition by friction, such that they must be struck against a friction pad similar to normal matches. This requires reasonably fine finger movement and two hands, and windproof matches are only windproof for a couple of seconds. Consequently, alternative methods of starting fires have been proposed which are relatively unaffected by weather conditions, do not require the use of paper or kindling wood, and require little or no skill to use.

Alternative fire starting methods generally involve the use of either liquid-fuel or solid-fuel fire starters. Liquid-fuel fire starters have the disadvantage of being highly flammable and are subject to flashbacks, making them more dangerous to store and use than solid fuels. Solid-fuel fire starters are commonly blocks of paraffin wax mixed with a cellulose material, such as sawdust or woodchips. The blocks are placed on a support located below a stack of wood, charcoal, etc., and are ignited using a manually-held flame source, such as a match or lighter, thereby requiring the user to have at least his hand in proximity to the fire area. Solid-fuel fire starters can also be wrapped in a flammable bag that the user lights, which in turn, lights the solid fuel. However, all solid-fuel fire starters are subject to a user's ability (e.g., hand/finger agility) to hold a match or lighter up to the fire starter long enough to allow the flammable bag and/or the solid fuel to combust. This requirement can present significant challenges when in a windy, moist outdoor environment. Gas fire starters, such as turbo lighters, suffer from the effects of wind and require fine finger movement to activate the gas fire starter and oxygen to produce a flame.

SUMMARY

To solve the problems of existing fire starters, the present disclosure provides a fire starter that does not require oxygen to ignite or maintain a flame and makes it easy to ignite using one or no fingers, such as teeth.

A fire starter includes a burnable casing forming a sealed chamber. A first burnable mixture and a second burnable mixture are separately disposed in the sealed chamber. The first burnable mixture is capable of forming a flame without oxygen from the air in an environment external to the casing. An igniter is disposed in the sealed chamber adjacent to the first burnable mixture and configured to generate a first thermal event to ignite the first burnable mixture without oxygen from the air in the external environment. The first burnable mixture combusts during the first thermal event and triggers a second thermal event to ignite the second burnable mixture. An actuator is coupled to the igniter. The actuator is configured to activate the igniter to generate the first thermal event. The interior chamber may be air-tight and/or liquid-tight. The actuator has a portion positioned outside of the casing and a pull handle positioned at one end of the portion that is configured for receiving a pulling force without using more than one finger to activate the igniter. The pull handle includes a handle portion and an opening. The handle portion has a ring shape, and the opening has a circular shape.

The fire starter includes a stopper seal disposed adjacent to the second burnable mixture, a bottom end cap to hold the stopper seal at one end of the burnable casing, a sealing layer attached to the other end of the burnable casing, an adhesive securing layer to secure the sealing layer, and a fuse connecting the igniter to the first burnable mixture. The igniter comprises an ignition line and a fuel container containing fuel for the generation of the first thermal event.

The first burnable mixture may include an oxidizer, such as a chemical compound containing a chlorate anion or a compound having a standard electrode potential in volts relative to a standard hydrogen electrode of at least 1.15. The first burnable mixture may include potassium chlorate, starch, and charcoal. The first burnable mixture may include potassium chlorate, starch, charcoal, and thiourea. The first burnable mixture may include potassium chlorate, starch, charcoal, and guanidine nitrate. The first burnable mixture may include potassium chlorate, starch, charcoal, thiourea, and guanidine nitrate. The first burnable mixture may include ammonium perchlorate, potassium perchlorate, nitrocellulose, and stearic acid. The first burnable mixture may include sulfur and aluminum powder.

The igniter may include an ignitable material, such as an oxidizer. The ignitable material may include an oxidizer containing a chlorate anion. The ignitable material may include an oxidizer that has a standard electrode potential in volts relative to a standard hydrogen electrode of at least 1.15. The ignitable material may include potassium chlorate, antimony trisulphide, nitrocellulose, lead thiocyanate, charcoal, and silicon carbide.

The second burnable mixture combusts during the second thermal event and triggers a third thermal event to ignite the burnable casing. The second thermal event further ignites the burnable casing. The second burnable mixture comprises a mixture of wax and pieces of cellulose material.

The first burnable mixture burns for a first length of time after being ignited, the second burnable mixture burns for a second length of time after being ignited, and the second length of time is not shorter than the first length of time.

DETAILED DESCRIPTION OF THE EMBODIMENTS

Figure 1:
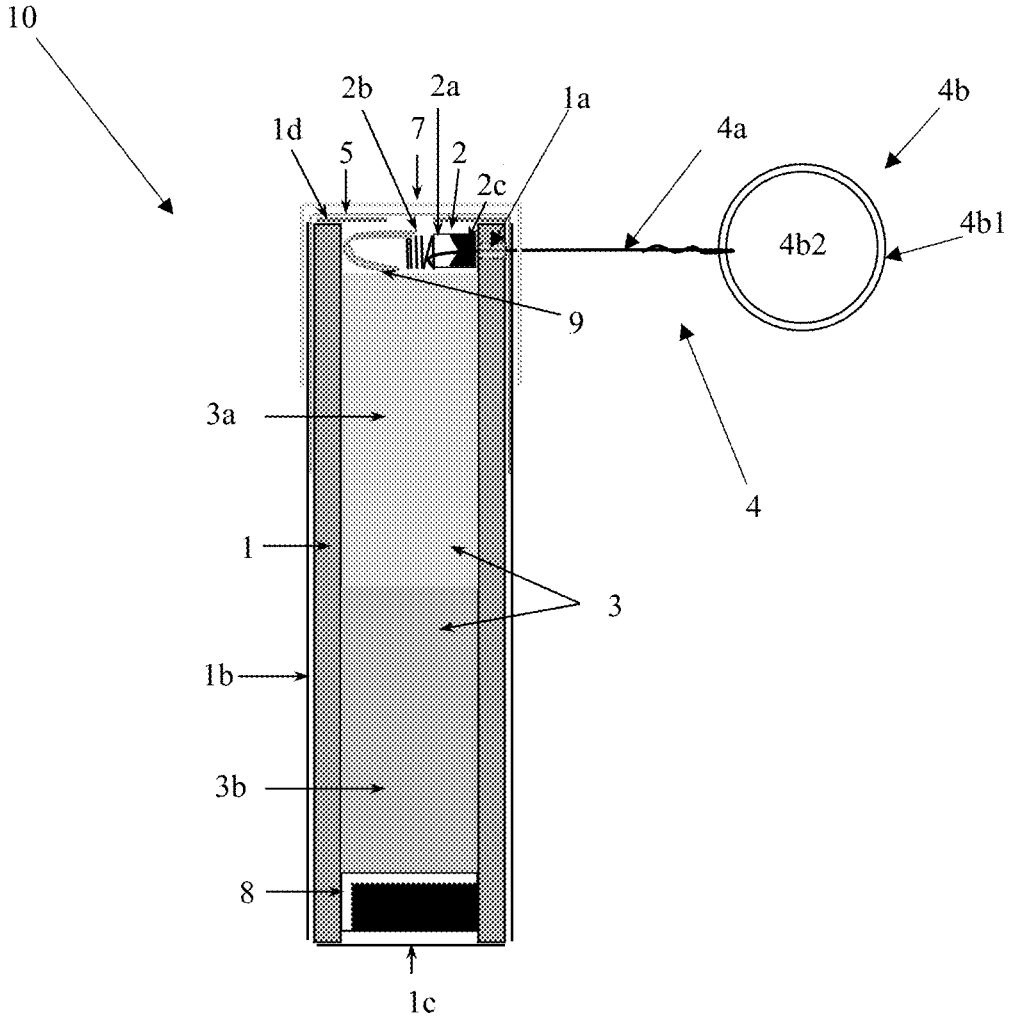
FIG. 1 is a plan view of a fire starter and the components disposed therein in accordance with an embodiment of the present invention.

Referring now to the drawings and more particularly to FIG. 1, a fully self-contained fire starter in accordance with an embodiment of the present invention is shown and is referenced generally by the numeral 10. Fire starter 10, as well as all other embodiments of the present invention described and/or illustrated herein, is self-contained in that no external source of thermal energy is required to initiate combustion. Rather, the fire starter need only be placed in a fire-starting location and activated by a simple and non-thermal manual activity to initiate combustion that does not require a high level of hand/finger agility. While the fire starter can be used in indoor and outdoor environments, a great advantage of the present invention is that the fire starter will work even in the most extreme conditions, such as very windy and moist outdoor environments. The fire starter enables the user to ignite a fire in an emergency. The fire starter produces a flame that lasts between 0.5 and 4.5 minutes, such as 0.5 and 3 minutes or 1-2 minutes. The user can hold the fire starter in the hand for between 15 seconds and 45 seconds, such as a minimum of 30 seconds.

The fire starter of the present invention is a novel arrangement of elements that, when activated, produce a plurality of thermal events with the last thermal event being an enduring flame suitable for starting a fire in a stack of wood, charcoal, etc. Fire starter 10 includes an outer casing 1, an igniter 2 disposed in casing 1, a combustible material 3 disposed in casing 1 adjacent to igniter 2, and an actuator 4 coupled to igniter 2 and positioned outside of casing 3. While the overall size of fire starter 10 is not a limitation of the present invention, the entirety of fire starter 10 can generally be a hand-held structure. The fire starter 10 should be as small as possible, easily portable, and can be added to any survival kit. The fire starter 10 may have a diameter of between 21.25 mm and 28.75 mm, such as 25 mm, and a length of about 90 mm and 110 mm, such as 100 mm. The fire starter produces a fierce flame from the end of the casing where the igniter is situated (e.g., top end) and burns away the entire fire starter except for the actuator.

Casing 1 is made from a combustible material that provides the fuel for the final thermal event (i.e., a fire-starting enduring flame) for an activated fire starter 10. In general, casing 1 is made from a solid material that, once ignited, will burn for a sufficient period of time (e.g., between 0.5 minutes and 1.5 minutes, such as about 1 minute) to ignite surrounding wood, charcoal, etc. that is adjacent to a burning casing 1. A suitable material choice for casing 1 is a cellulose material produced from cellulose fibers. An example of suitable cellulose materials includes paper-based materials, including heavy paper-based materials, such as cardboard, which includes paperboard, corrugated fiberboard, etc. Casing 1 may weigh between 9.8 g and 18.4 g. such as 14 g. Casing 1 may have an outer diameter between 19.55 mm and 26.45 mm, such as 23 mm, an inner diameter between 15.3 mm and 20.7 mm, such as 18 mm, and a length between 90 mm and 110 mm, such as 100 mm. Label 1*b* may be integrally formed with casing 1, such as printing on casing 1, or separately formed from casing 1, such as a layer covering a longitudinal portion (some or all) of casing 1. Label 1*b* is made from a combustible material 3. If separately formed from casing 1, label 1*b* may be formed from cellulose material, such as paper. For a fire starter that weighs between 37.76 g-56.64 g, such as 47.2 g, label 1*b* may weigh between 0.1 g and 0.3 g, such as 0.2 g. Label 1*b* may cover a portion (some or all) of the longitudinal portion of casing 1. Label 1*b* may have a first dimension (e.g., width) between 72 mm and 88 mm, such as 80 mm, and a second dimension (e.g., length or height) between 85.5 mm and 104.5 mm, such as 95 mm. Label 1*b* may be wrapped about casing 1 more than once. Label 1*b* may supply further combustible material as fuel for the thermal events.

Casing 1 can be formed or constructed to define a well or an internal chamber in which igniter 2 and combustible material 3 are disposed. The internal chamber may be air-tight and/or liquid-tight. Casing 1 may form part or all of a chamber that houses igniter 2 and combustible material 3. Casing 1 can be a unitary body or could be an assembled arrangement of casing portions without departing from the scope of the present invention. The internal chamber is sealed from the external environment. Oxygen from the air in the external environment is not required to start or maintain a flame.

Figure 2:
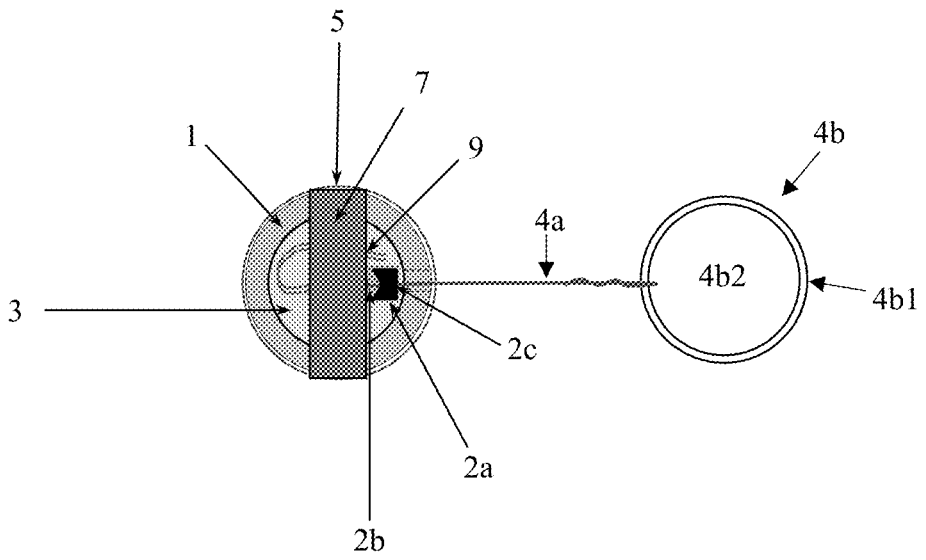
FIG. 2 is a top view of the fire starter of FIG. 1.
Figure 4:
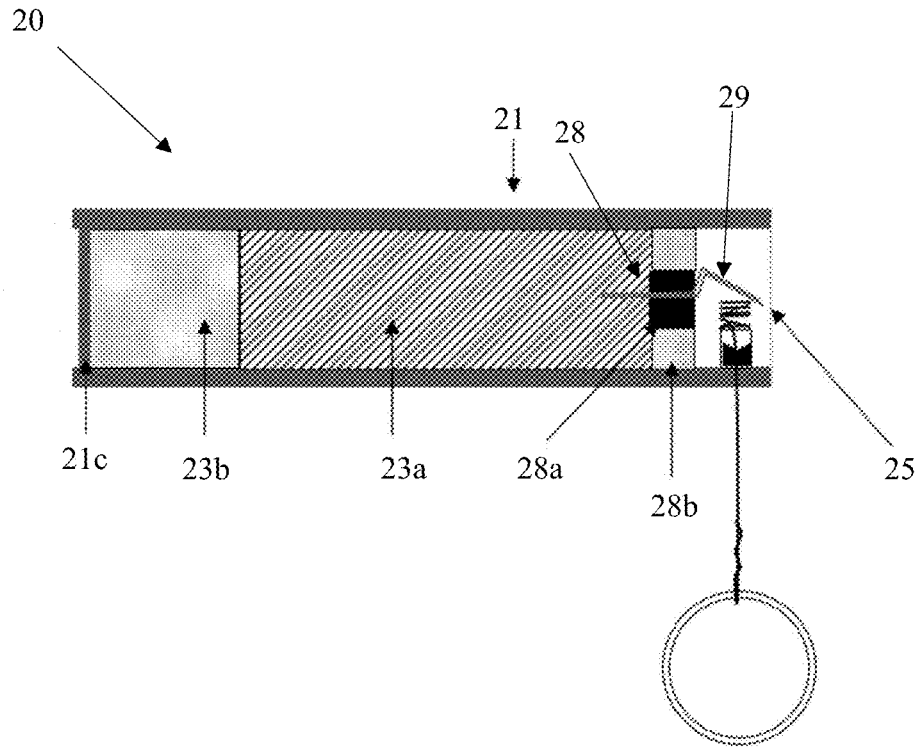
FIG. 4 is a plan view of a fire starter and the components disposed therein in accordance with another embodiment of the present invention.

As shown in FIGS. 1, 2, and 4, a sealing layer 5 (or membrane 25) is attached to one end (e.g., top end) of casing 1 and bottom end cap 1*c* (e.g., bottom end) is attached to the other end of casing 1 to ensure that the internal chamber is not exposed to the environment external to casing 1 and prevent combustible material 3 from being released from the top end of casing 1. Bottom end cap 1*c* may have an outer diameter between 21.25 mm and 28.75 mm, such as 25 mm. As shown in FIG. 1, sealing layer 5 may cover the end of casing 1 and a longitudinal portion (some or all) of casing 1. The sealing layer 5 may completely cover casing 1, including the ends and the longitudinal portion therebetween. As shown in FIG. 4, the sealing layer (or membrane 25) covers only the end of casing 1. In this case, membrane 25 may attach at the end of casing 1 by fitting within the interior chamber of casing 1 or attaching to the sidewall at the of casing 1 that defines the circumference of casing 1. A suitable material choice for sealing layers 5 or 25 is a film produced from a plastic or polymeric material. For example, sealing layers 5 or 25 may be produced from a thermoplastic material, such as polyvinyl chloride, polyethylene, polypropylene, polyester, etc. For example, sealing layers 5 or 25 may be produced from an elastomeric material, such as a rubber material produced from isoprene, latex, etc. Sealing layers 5 or 25 may be transparent, which may allow visualization of the interior chamber. For a fire starter that weighs between 37.76 g-56.64 g, such as 47.2 g, the plastic film may weigh between 0.05 g and 0.15 g, such as 0.1 g.

As shown in FIGS. 1 and 2, securing layer 7 may be secured over sealing layer 5 to secure sealing layer 5 onto the end of casing 1. A suitable material choice for securing layer 7 is an adhesive material, such as tape. The tape may be made from materials, such as paper. For a fire starter that weighs between 37.76 g-56.64 g, such as 47.2 g, the paper tape may weigh between 0.05 g and 0.15 g, such as 0.1 g. The paper tape may have a first dimension of 49.5-60.5 mm, for example, 55 mm, and a second dimension of 6.8-9.2 mm, for example, 8 mm. Securing layer 7 may cover a portion (e.g., part or all) of the sealing layer 5, including part of all the sealing layer 5 at the end of casing 1 and/or part or all the longitudinal portion of the sealing layer 5 on the longitudinal portion of casing 1. Securing layer 7 may be transparent, which may allow visualization of the interior chamber.

As shown in FIG. 1, top end cap 1*d* may be interposed between sealing layer 5 and the top end of casing 1, such that top end cap 1*d* may attach to the sidewall at the top end of casing 1. A suitable material choice for top end cap 1*d* is a cellulose material, such as paper or a cardboard disc. Top end cap td may cover a portion (some or all) of the end of casing 1. For example, top end cap td may have an opening 1*d*1 through its center. Top end cap 1*d* may take any shape, such as a circular shape, and if there is an opening in the top end cap 1*d*, the opening may take any shape regardless of whether it is the same shape as top end cap 1*d*, such as a circular opening. The opening may be covered with a film, which may be made from a suitable material, such as plastic, for example, a transparent plastic material, which allows visualization of the interior chamber and seals the contents of the interior chamber from leaking out. The disc with a hole may have an outer diameter between 21.25 mm and 28.75 mm, such as 25 mm, and a thickness between 0.85 mm and 1.15 mm, such as 1 mm. For a fire starter that weighs between 37.76 g-56.64 g, such as 47.2 g, top end cap 1*d* may weigh between 0.1 g and 0.3 g, such as 0.2 g.

Bottom end cap 1*c* or 21*c* may fit within the interior chamber or inner diameter of casing 1. The bottom end cap nay have an outer diameter between 21.25 nm and 28.75 mm, such as 25 mm. As shown in FIG. 1, bottom end cap 1*c* may be positioned in a manner that is flush with the sidewall at the end of casing 1 which defines the circumference of casing 1. As shown in FIG. 4, bottom end cap 21*c* may be positioned further into the interior chamber of casing 1, such that an indent is formed at the bottom end of casing 1. Bottom end cap 1*c* or 21*c* may be separately or integrally formed with casing 1. A suitable material choice for end cap 1*c* or 21*c* is a cellulose material, such as paper or a cardboard disc. A stopper seal 8 may be disposed between bottom end cap 1*c* or 21*c* and combustible material 3 to further seal the interior chamber within casing 1 from being exposed to the environment external to casing 1. The stopper seal 8 is a material that will not react with the combustible material 3. A suitable material choice for the stopper seal 8 is a ceramic material, such as clay. For a fire starter that weighs between 37.76 g-56.64 g, such as 47.2 g, the stopper seal 8 may weigh between 1.8 g and 4.2 g, such as 3 g. The stopper seal 8 should sealingly fit within the interior chamber of casing 1, such that the diameter of the stopper seal 18 should be close to the inner diameter of casing 1. In some cases, the stopper seal 18 may be made from a pliable, deformable material that may measure more than the inner diameter of casing 1 and deformed to fit within the interior chamber of casing 1. The stopper seal 8 may have a first dimension (e.g., diameter) between 15.3 mm and 20.7 mm, such as 18 mm, and a second dimension (e.g., length) between 6.8 mm and 9.2 mm, such as 8 mm, or between 8.5 mm and 11.5 mm, such as 10 mm.

Oxygen from the air is not required to start or maintain a flame due to the composition of the combustible material 3. The combustible material may include a composition for producing smoke or a flame. Combustible material 3 is the fuel for a thermal event that will trigger the combustion of casing 1. In general, the thermal event created when combustible material 3 combusts must last long enough to ignite casing 1 to combustion. To assure efficient combustion of combustible material 3 even in a low oxygen environment (e.g., essentially oxygen-free), a chemical agent that can help produce a flame in the absence of contributing oxygen from the environment, such as an oxidizer, can be included in combustible material 3. When casing 1 forms part or all of an internal chamber housing combustible material 3, the inclusion of an oxidizer in combustible material 3 is particularly beneficial. The oxidizer should be a relatively strong oxidizer with a standard electrode potential (E°) in volts relative to the standard hydrogen electrode that is greater than 0.958, 0.96, 1, or 1.15. A suitable oxidizer is a chemical compound containing the chlorate anion, which may have a standard electrode potential of about 1.18. The length of time that combustible material 3 must burn will generally be less than the burn time associated with casing 1. By way of example, when casing 1 is made from the above-described cellulose-based material such as cardboard, combustible material 3 can be a mixture of materials capable of burning for a time in the range of approximately 50 seconds to approximately 95 seconds.

As shown in FIGS. 1, 2, and 4, combustible material 3 may include a first burnable mixture 3*a* and a second burnable mixture 3*b*. The combustible material 3 may produce a small, concentrated flame like a gas torch. The first burnable mixture 3*a* may be pyrotechnic composition, and the second burnable mixture 3*b* may be a natural flame fueled by a mixture of wax and sawdust. A flame may be initially produced by the pyrotechnic composition and sustained as a natural flame fueled by a mixture of wax and sawdust. The first burnable mixture 3*a* may have a burn time between 0.5 minutes to 1.5 minutes, such as at least 1 minute. The first burnable mixture 3*a* may have a burn time between 0.5 minutes to 3 minutes, such as 1-2 minutes. The first burnable mixture 3*a* may be separate and distinct from the second burnable mixture 3*b*, such that the first burnable mixture 3*a* is not mixed with the second burnable mixture 3*b* and the first burnable mixture 3*a* is positioned adjacent to the second burnable mixture 3*b*. In this case, in addition to being the fuel for a thermal event that will trigger the combustion of casing 1, the first burnable mixture 3*a* is the fuel for a thermal event that will trigger the combustion of the second burnable mixture 3*b*, and the second burnable mixture 3*b* can also be the fuel for a thermal event that will trigger the combustion of casing 1. Both the first burnable mixture 3*a* and the second burnable mixture 3*b* may be the fuel for a thermal event that will trigger the combustion of casing 1. Casing 1 can contain about 13.6 g to 20.4 g of a first burnable mixture 3*a*, for example, 17 g of a first burnable mixture 3*a*, and about 7 g to 13 g of a second burnable mixture 3*b*, for example, 10 g of a second burnable mixture 3*b*.

In a first example, the first burnable mixture 3*a* includes ammonium perchlorate, potassium perchlorate, nitrocellulose, and stearic acid. In this case, the first burnable mixture 3*a* may include about 17.6 wt %-26.4 wt % ammonium perchlorate, for example, 22 wt % ammonium perchlorate. In this case, the first burnable mixture 3*a* may include about 17.6 wt %-26.4 wt % potassium perchlorate, for example, 22 wt % potassium perchlorate. In this case, the first burnable mixture 3*a* may include about 39.6 wt %-48.4 wt % nitrocellulose, for example, 44 wt % nitrocellulose. In this case, the first burnable mixture 3*a* may include about 9.6 wt %-14.4 wt % stearic acid, for example, 12 wt % stearic acid. In this case, the nitrocellulose has a nitrogen content of 9.76 wt %-15.12 wt %, for example, 12.2-12.6 wt %. If casing 1 contains 17 g of the first burnable mixture 3*a* in the first example, casing 1 may contain 3.74 g of ammonium perchlorate, 3.74 g of potassium perchlorate, 7.48 g of nitrocellulose, and 2.04 g of stearic acid. Ammonium perchlorate and potassium perchlorate are oxidizers.

In a second example, the first burnable mixture 3*a* includes potassium chlorate, starch, and charcoal. The first burnable mixture 3*a* in the second example may optionally include thiourea and/or guanidine nitrate. In a third example, the first burnable mixture 3*a* includes potassium chlorate, starch, and magnesium carbonate with a small amount of nitrocellulose. Potassium chlorate is an oxidizer. In a fourth example, the first burnable mixture 3*a* includes a mixture of sulfur and aluminum powder. In addition to being fuel for a thermal event, sulfur may also be an oxidizer.

As an example, the second burnable mixture 3*b* includes wax (e.g., paraffin wax) and cellulose material, such as sawdust, woodchips, etc., for example, compacted wax enveloping sawdust. The ratio of wax to cellulose material can be "one-to-one" or "greater-than-one to one," for example, 50 wt % wax and 50 wt % sawdust, without departing from the scope of the present invention. In general, flame height will increase but the flame's life span will decrease with increasing amounts of paraffin wax. Accordingly, the ratio of paraffin wax to cellulose material can be tailored to suit a product's application. By way of example, a ratio of paraffin wax to cellulose material of approximately 1.5 to 1 provides a good balance between flame height and life span for most indoor and outdoor applications.

In some examples, the first burnable mixture 3*a* and the second burnable mixture 3*b* are mixed to form the combustible material 3. In this case, the first burnable mixture 3*a* and the second burnable mixture 3*b* are not separate and distinct from each other. In a first example, the combustible material 3 includes ammonium perchlorate, potassium perchlorate, nitrocellulose, stearic acid, wax, and sawdust. In a second example, the combustible material 3 includes potassium chlorate, starch, charcoal, wax, sawdust, and optionally thiourea and/or guanidine nitrate. In a third example, the combustible material 3 includes potassium chlorate, starch, and magnesium carbonate with a small amount of nitrocellulose, wax, and sawdust. In a fourth example, the first burnable mixture 3*a* includes a mixture of sulfur aluminum powder, wax, and sawdust.

As shown in FIGS. 1 and 4, igniter 2 is positioned adjacent to combustible material 3. In general, igniter 2 is capable of generating a thermal event that triggers the combustion of combustible material 3. That is, the thermal event produced by igniter 2 must last long enough to ignite combustible material 3. Depending on the material used for combustible material 3, the thermal event provided by igniter 2 (when activated) could be a spark, a small burn event (e.g., a burning fuse), a chemical reaction, etc. Igniter 2 can be a spark generator, which can be any of a variety of mechanically-activated friction-type sparking devices such as but not limited to, pull-type spark generators (also known as "poppers") and push-type spark generators used in conventional gas grills. By way of example, when using the above-noted mixtures for combustible material 3, igniter 2 needs to provide a small burn event, such as a fierce flame even in the most extreme wind condition, having a burn time in the range of approximately 4 seconds to approximately 5 seconds. Fuse 9 is coupled to igniter 2 and extends therefrom to contact combustible material 3. Fuse 9 can be any conventional fuse or primer cord that combusts to define a short-term burn event (e.g., on the order of approximately 4-5 seconds) when exposed to a spark.

Figure 3:
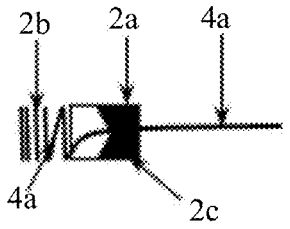
FIG. 3 is an enlarged view of the igniter shown in FIG. 1.

In one example as shown in FIG. 3, Igniter 2 includes a fuel container 2*a* and an ignition line 2*b* that is connected to fuel container 2*a* and actuator 4. A suitable material choice for ignition line 2*b* is metal, such as a roughened steel wire. The fuel container 2*a* may be any shape configured to hold liquid fuel, such as a cup. Fuel container 2*a* may be made from a material that will not react with the fuel or is not permeable by the fuel, such as a metal material, for example, copper. Fuel container 2*a* may have an inner diameter between 3.4 mm and 4.6 mm, such as 4 mm, an outer diameter between 4.03 mm and 5.47 mm, such as 4.75 mm, and a height between 4.5 mm and 5.5 mm, such as 5 mm. Igniter fuel 2*c* in fuel container 2*a* may include a chemical agent that produces a flame in the absence of contributing oxygen from the environment, such as an oxidizer. The oxidizer should be a relatively strong oxidizer with a standard electrode potential (E°) in volts relative to the standard hydrogen electrode that is greater than 0.958, 0.96, 1, or 1.15. A suitable oxidizer is a chemical compound containing the chlorate anion, which may have a standard electrode potential of about 1.18 Fuel 2*c* may include potassium chlorate, antimony trisulfide, nitrocellulose, lead thiocyanate, charcoal, and silicon carbide. Potassium chlorate is an oxidizer. Casing 1 can contain between 0.0325 g and 0.0975 g of fuel, such as 0.065 g of fuel. In fuel composition 2*c*, there may be between 40.05 wt % and 48.95 wt % of potassium chlorate, such as 44.5 wt % potassium chlorate. In fuel composition 2*c*, there may be between 17.2 wt % and 25.8 wt % of antimony trisulfide, such as 21.5 wt % antimony trisulfide. In fuel composition 2*c*, there may be between 6.08 wt % and 9.12 wt % of nitrocellulose, such as 7.6 wt % nitrocellulose. In this case, the nitrocellulose has a nitrogen content of 9.76 wt %-15.12 wt %, for example, 12.2-12.6 wt %. In fuel composition 2*c*, there may be between 7.68 wt % and 11.52 wt % of lead thiocyanate, such as 9.6 wt % lead thiocyanate. In fuel composition 2*c*, there may be between 1.2% and 1.8 wt % of charcoal, such as 1.5 wt/o charcoal. In fuel composition 2*c*, there may be between 12.24 wt % and 18.36 wt % of silicon carbide, such as 15.3 wt % silicon carbide.

Actuator 4 is coupled to igniter 2 but is positioned outside of casing 1. In general, actuator 4 is a manually-operated element that activates igniter 2 such that igniter 2 produces the igniter's above-described thermal event. As mentioned above, the manual operation applied to actuator 4 does not include or require the application of any external source of thermal energy. Actuator 4 can be realized by a structure that is manually pulled or manually pushed where such action activates igniter 4. By way of an illustrative example, if igniter 2 is a pull-type device (e.g., pull-type spark generator), actuator 4 includes a pull line/string 4*a* and a pull handle 4*b*. The pull line 4*a* is coupled to igniter 2 and extended through casing 1 to be accessible on the outside of casing 1. Specifically, pull line 4*a* is connected to ignition line 2*b* of igniter 2. An opening 1*a* may be provided in casing 1 through which pull line 4*a* may extend out of the interior chamber. By attaching pull line 4*a* to igniter 2, a pulling/activating force applied to actuator 4 does not get transferred to casing 1. By isolating casing 1 from the pulling/activating force, casing 1 is not subject to tensile stresses. Isolating casing 1 from tensile stresses is important when casing 1 is made from cellulose material, such as paper or cardboard, i.e., a material that does not possess high tensile strength. For a fire starter that weighs between 37.76 g-56.64 g, such as 47.2 g, the pull line 4*a* may weigh between 0.2 g and 0.6 g, such as 0.4 g. Pull line 4*a* may be made from suitable materials possessing sufficient tensile strength, such as metal, for example, smooth steel wire.

At the other end of the pull line 4*a* opposite from the end where igniter 2 is attached, a pull handle 4*b* is attached. Pull handle 4*b* allows the user to activate the fire starter and produce a flame with limited use of fingers. The pull handle 4*b* does not require manipulation by two or more fingers to activate the igniter 2. The pull handle 4*b* is configured for one-finger or no-finger manipulation. The pull handle 4*b* has a handle portion 4*b*1 with an opening 4*b*2 therein, such as the ring defined by the circular handle portion 4*b*1 and circular opening 4*b*2 as shown in FIG. 1. The handle portion 4*b*1 may take other shapes, such as a rectangle with an opening therein. The opening 4*b*2 may take other shapes, such as a rectangle. The handle portion 4*b*1 and the opening 4*b*2 need not be the same shape. The opening 4*b*2 allows the user to pull the pull handle 4*b* using only one finger or other parts of the body, such as teeth, toes, etc., or other non-body part objects, such as a stick, hook, etc. For example, the opening may be used to hook the pull handle around a fixed object (e.g., a branch), and the fire starter may be pulled in a direction away from the fixed object. In another example, a user may hold the fire starter in one hand and use the index finger or thumb on the same or different hand to pull the pull handle from the fire starter. Either the pull handle or fire starter may be fixed, and the other of the pull handle or fire starter may be pulled to activate the fire starter. This is particularly helpful in situations where a user is injured or has restricted use of their hands/fingers, such as from frostbite. The pull handle may be positioned between 1.5 mm and 4.5 mm, such as about 3 mm, down from the top end of the casing. For a fire starter that weighs between 37.76 g-56.64 g, such as 47.2 g, the pull handle 4*b* may weigh between 1.2 g and 2.8 g, such as 2.0 g. The ring-shaped pull handle 4*b* may have an inner diameter between 17 mm and 23 mm, such as 20 mm, and an outer diameter between 18.7 mm and 25.3 mm, such as 22 mm. The ring may be made of materials possessing sufficient tensile strength, such as metal.

If sealing layer 5 and/or securing layer 7 is used, the pull line 4*a* may extend through sealing layer 5 and/or securing layer 7 to the environment external to the interior chamber within casing 1. The materials and/or the production method to extend the pull line 4*a* out of the interior chamber and into the environment external to casing 1 may be used to ensure that the interior chamber is not exposed to the environment external to casing 1. For example, the materials may have self-sealing characteristics, or the materials may be formed or patched around pull line 4*a*.

FIG. 4 shows another embodiment of a fire starter. As shown in FIG. 4, fire starter 20 has a bottom end cap 1*c* that is not flush with casing 21. Fire starter 20 also does not have a stopper seal, top end cap, or securing layer. Fire starter 20 shows a fuse fixer 28 disposed within the interior chamber of casing 21. Fuse fixer 28 includes fuse fixing portion 28*a* interposed between side portions 28*b* for receiving and fixing fuse 29. The fuse fixing portion 28*a* may be made from a solid material that does not interfere with the operation of the fuse and stably fixes the fuse. The solid material may include a flammable substance (e.g., flammable powder). The flammable substance may be a cellulose material or powder, such as nitrocellulose, or a carbon material, such as charcoal. The solid material may also include a binder, such as an adhesive or glue, so the mixture of the flammable substance and binder forms a solid when dried. An example of a flammable substance is a mixture of nitrocellulose and charcoal. The flammable substance may contain 66 wt % nitrocellulose and 34 wt % charcoal. The flammable substance is not limited to nitrocellulose or charcoal but may be any material or powder that is flammable, and there are a large number of possibilities. The side portions 28*b* may be made from any material that is compatible with the fuse fixing portion 28*a*, such as a ceramic material, for example, clay. Fire starter 20 also shows a membrane 25 attached to the sidewalls at the end of casing 1. The amount of first burnable mixture 23*a* is larger than the amount of the second burnable mixture 23*b* as compared to FIG. 1, which shows that the amount of first burnable mixture 23*a* is about the same as second burnable mixture 23*b*.

What is claimed is:

1. A fire starter comprising:

a burnable casing forming a sealed chamber;

a first burnable mixture and a second burnable mixture are separately disposed in the sealed chamber, wherein the first burnable mixture is capable of forming a flame without oxygen from air in an environment external to the casing;

an igniter disposed in the sealed chamber adjacent to the first burnable mixture and configured to generate a first thermal event to ignite the first burnable mixture without oxygen from air in an environment external to the casing, the first burnable mixture combusts during the first thermal event and triggers a second thermal event to ignite the second burnable mixture;

an actuator coupled to the igniter, the actuator configured to activate the igniter to generate the first thermal event;

a stopper seal disposed adjacent to the second burnable mixture;

a bottom end cap to hold the stopper seal at one end of the burnable casing;

a sealing layer attached to the other end of the burnable casing;

an adhesive securing layer to secure the sealing layer; and a fuse connecting the igniter to the first burnable mixture, wherein the igniter comprises an ignition line and a fuel container containing fuel for the generation of the first thermal event.

2. The fire starter of claim 1, wherein the actuator has a portion positioned outside of the casing and a pull handle positioned at one end of the portion that is configured for receiving a pulling force without using more than one finger to activate the igniter, the pull handle comprising a handle portion and an opening.

3. The fire starter of claim 2, wherein the handle portion includes a ring shape and the opening includes a circular shape.

4. The fire starter of claim 1, wherein the first burnable mixture comprises a chemical compound containing a chlorate anion.

5. The fire starter of claim 1, wherein the first burnable mixture comprises an oxidizer that has a standard electrode potential in volts relative to a standard hydrogen electrode of at least 1.15.

6. The fire starter of claim 1, wherein the first burnable mixture comprises potassium chlorate, starch, and charcoal.

7. The fire starter of claim 1, wherein the first burnable mixture comprises potassium chlorate, starch, charcoal, and thiourea.

8. The fire starter of claim 1, wherein the first burnable mixture comprises potassium chlorate, starch, charcoal, and guanidine nitrate.

9. The fire starter of claim 1, wherein the first burnable mixture comprises potassium chlorate, starch, charcoal, thiourea, and guanidine nitrate.

10. The fire starter of claim 1, wherein the first burnable mixture comprises ammonium perchlorate, potassium perchlorate, nitrocellulose, and stearic acid.

11. The fire starter of claim 1, wherein the first burnable mixture comprises sulfur and aluminum powder.

12. The fire starter of claim 1, wherein the igniter comprises an ignitable material, the ignitable material comprising an oxidizer.

13. The fire starter of claim 1, wherein the igniter comprises an ignitable material, the ignitable material comprising a chemical compound containing a chlorate anion.

14. The fire starter of claim 1, wherein the igniter comprises an ignitable material, the ignitable material comprising an oxidizer that has a standard electrode potential in volts relative to a standard hydrogen electrode of at least 1.15.

15. The fire starter of claim 1, wherein the igniter comprises an ignitable material, the ignitable material comprising potassium chlorate, antimony trisulphide, nitrocellulose, lead thiocyanate, charcoal, and silicon carbide.

16. The fire starter of claim 1, wherein the second burnable mixture combusts during the second thermal event and triggers a third thermal event to ignite the burnable casing.

17. The fire starter of claim 1, wherein the second thermal event further ignites the burnable casing.

18. The fire starter of claim 1, wherein the second burnable mixture comprises a mixture of wax and pieces of cellulose material.

19. The fire starter of claim 1, wherein:

the first burnable mixture burns for a first length of time after being ignited, the second burnable mixture burns for a second length of time after being ignited, and the second length of time is not shorter than the first length of time.

* * * * *